US006487727B1

(12) United States Patent
Harsant

(10) Patent No.: US 6,487,727 B1
(45) Date of Patent: Dec. 3, 2002

(54) NIGHTWEAR FOR CHILDREN OR INCONTINENT PERSONS

(76) Inventor: Anne Harsant, 10 rue des Tanneries, F-75013 Paris (FR)

( * ) Notice: Subject to any disclaimer, the term of this patent is extended or adjusted under 35 U.S.C. 154(b) by 0 days.

(21) Appl. No.: 09/857,798

(22) PCT Filed: Nov. 24, 1999

(86) PCT No.: PCT/FR99/02895

§ 371 (c)(1),
(2), (4) Date: Jun. 11, 2001

(87) PCT Pub. No.: WO00/33683

PCT Pub. Date: Jun. 15, 2000

(30) Foreign Application Priority Data

Dec. 9, 1998 (FR) ..... 98 15537
Apr. 20, 1999 (FR) ..... 99 04960

(51) Int. Cl.[7] ..... A41B 13/02
(52) U.S. Cl. ..... 2/400; 2/83; 2/80
(58) Field of Search ..... 2/227–228, 238, 2/73, 400–408, 80, 83, 114, 79, 78.1–78.3; 604/385.1–396

(56) References Cited

U.S. PATENT DOCUMENTS 2,621,336 A * 12/1952 Wendroff ..... 2/80
3,111,680 A * 11/1963 Horowitz et al. ..... 2/227
3,180,336 A * 4/1965 Bett et al. ..... 2/227
3,648,699 A * 3/1972 Anderson et al. ..... 604/385.1
4,735,622 A * 4/1988 Acuff et al. ..... 604/385.1

FOREIGN PATENT DOCUMENTS

| | | | | |
|---|---|---|---|---|
| CA | 1000001 | | 11/1976 | |
| EP | 187727 | * | 7/1986 | 604/385.1 |
| GB | 819558 | * | 9/1959 | 2/227 |
| GB | 1162532 | * | 8/1969 | 2/227 |
| GB | 1 494 196 | | 12/1977 | |
| GB | 1494196 | * | 12/1977 | 2/227 |

* cited by examiner

*Primary Examiner*—Gloria M. Hale
(74) *Attorney, Agent, or Firm*—Young & Thompson

(57) ABSTRACT

The garment (1) intended for children who are enuretic or are undergoing toilet training, or for incontinent persons, is impermeable but has a permeable internal face (3) coming into contact with the skin. It incorporates sealing devices (4) for preventing the flow of urine outside the garment. The garment can also incorporate pieces of absorbent material (5) disposed on the internal face (3) of the garment (1) close to the sealing devices (4).

20 Claims, 4 Drawing Sheets

NIGHTWEAR FOR CHILDREN OR INCONTINENT PERSONS

FIELD OF THE INVENTION

The present invention concerns a night garment intended for children who are enuretic or undergoing toilet training, or for incontinent persons.

BACKGROUND OF THE INVENTION

At the present time there exists no night garment specially adapted for children who are enuretic or undergoing toilet training.

A child is considered to be enuretic if he continues to wet his bed beyond 3 years of age. This nocturnal enuresis can sometimes last up to the age of 14 years or even beyond.

At the present time, in order to avoid wetting the bedding, use is made of disposable diapers for babies. However, wearing such diapers intended for a baby up to a maximum age of 3 to 4 years is totally unsuited to enuretic children or incontinent persons who can relearn hygiene.

In the opinion of the medical profession, in a therapy adapted to enuretic children, it is essential to eliminate the wearing of diapers.

In addition, psychologically, it is inconceivable continuing to put diapers on children of 10 years old or even more. The use of diapers beyond 3 or 4 years keeps the child in a regressive state, often sought by the child itself. This is the case, for example, with a toilet-trained child who, when a small brother or sister is born, begins to wet its bed again (secondary enuresis). Putting diapers on it again at this critical time will not help it to overcome its natural jealousy and accept this new birth. It is therefore found that, if wearing diapers is possible up to the age of 3 or 4 years, it is no longer possible beyond that.

Moreover, for younger children undergoing toilet training, wearing diapers which keep the child dry is not recommended, since keeping the child dry does not assist in toilet training.

In addition, certain persons whose incontinence cannot be re-educated accept the wearing of diapers with difficulty, this being felt to be infantile, or even degrading.

Specific night clothing has been proposed for incontinent adults and for children. U.S. Pat. No. 3,648,699 concerns a garment for an incontinent person or for a bedridden patient, consisting of an outer garment in the form of short trousers, inside which there is removably inserted an impermeable lining in the form of underpants covered with an absorbent material on the user side, with a configuration similar to that of the short trousers.

U.S. Pat. No. 2,621,336 concerns a night garment of the sleepsuit type, in two parts. An external part, made from a heat-retaining material, such as a cover, and a removable internal part consisting of a plastic lining preventing soiling of the bedding. These garments are overpajamas intended for very young children. U.S. Pat. No. 3,180,336 concerns pajamas for children consisting of trousers inside which a piece in the form of pants produced from plastics material is fixed to the waist but not to the crotch of the trousers, so as to enable the child wearing them to move its legs freely. This garment is provided with elastic at the waist and at the ankles in order to ensure comfort and warmth for the child. This garment can also cover the diapers worn by a very young child. Finally, CA U.S. Pat. No. 1,000,001 concerns a multilayer garment for incontinent persons or mainly for hospitalized patients, which opens and closes by means of attachment cords.

All these documents concern garments which are associated with the presence of diapers or fulfilling an overpajama function, but these garments cannot be applied to children who are enuretic or undergoing toilet training with whom it is wished to eliminate the diapers while preserving the bedding from any soiling.

SUMMARY OF THE INVENTION

Unexpectedly and surprisingly, the Applicant has produced a night garment for toilet training, pleasant to wear and discreet, which, whilst enabling the person wearing it to feel when they are wetting themselves, leaves the bedding dry.

Thus the object of the present invention is a night garment intended for children who are enuretic or undergoing toilet training, or for incontinent persons, reusable or for single use, characterised by the fact that it is impermeable but has a permeable internal face coming into contact with the skin and in that it incorporates sealing devices for preventing the flow of urine outside the garment.

Naturally, the expression "night garment " is not limitative to uses during the night but during all prolonged periods of sleep such as a siesta.

This night garment can be in all normal forms for this type of garment, notably sleepsuit, pajamas with long trousers, bermudas or shorts, a jumpsuit or simple pants.

The sealing devices are disposed so as to allow sealed contact between the garment and the body of the person wearing it and are disposed so as to prevent any leakage of urine through the ends of the garment. Preferably these devices are disposed at the waist and legs of the garment.

According to another embodiment of the garment according to the invention, the sealing devices are disposed so as to isolate the area cladding the buttocks from the remainder of the garment so that the person has the sensation of being wet without for all that being at risk of catching cold by being completely wet.

According to a particular embodiment, these sealing devices consist of elastic or a row of elastic elements or an elasticated band, sufficiently tight to afford a seal and sufficiently flexible not to interfere with the blood circulation.

This elastic sealing device can be disposed for example by stitching, in or externally to a hem in the waterproof material formed at the ends of the garment.

To reinforce this seal, it is also possible to make provision for disposing internally an absorbent strip close to the elastic sealing devices which can be of the type used as an absorbent material in nappies. This strip preferably has a width of between five and ten centimetres. In addition, it can be obtained by cutting from a continuous strip, which can then have visual markings, such as markings in the form of colours, signs, geometric figures or others, or graduations in centimetres, numerical or other, these visual markings constituting cutting marks.

The garment according to the invention can be made using a material composed of at least two layers placed one on top of the other, an impermeable outer layer and an internal layer permeable to fluids or a material consisting of a single layer having a double face, for example a textile, one of whose faces is coated with a waterproofing coating.

The impermeable external covering is produced from cloths coated with waterproofing, or a flexible polymer film such as polyethylene, PVC, polyurethane, rubber or mixtures thereof.

The permeable internal face is produced from a woven material such as flannel, terry cloth, or knitted such as jersey, preferably in the case of the reusable garment, or from non-woven material, based on cotton fibres or synthetic materials, or mixtures thereof preferably in the case of a garment for single use.

Naturally, the materials will be chosen according to whether the garment is for single use or is reusable.

In the case of a garment for single use or disposable, the external waterproof material is in the form of a fine film impermeable to fluids made from synthetic material, of the type used for the impermeable external covering of nappies, for example made from polyethylene, or to which an internal lining made from a non-woven material permeable to fluids is attached, for example of the type used for making disposable female panties. The flexible material can also be obtained from a non-woven material coated, by bonding or any other means, with an external waterproofing layer.

In the case of a reusable garment, the waterproof material is produced in a rubber film to which the woven lining is attached, or is obtained from a fabric coated with a waterproofing covering, for example PVC or polyurethane, of the type used for producing impermeable undersheets.

When he begins to wet himself, the enuretic or incontinent person may wake up and then interrupt his emission of urine in order to go to the toilet, thus limiting the quantity of urine expelled. Nevertheless, if the person does not wake up or wakes up too late, or in the case of large flows, according to another embodiment, the garment has in this case, as seen previously, a strip or pieces of absorbent material, disposed on the internal face of the garment, close to the sealing devices.

In the case of a garment for single use, this absorbent material can be adhesively bonded.

In the case of a reusable garment, the pieces of absorbent material are disposed removably on the internal face of the garment, and attached by adhesive fixing or by contact. These pieces of absorbent material can be provided on one face with a strip fixed adhesively or by contact.

According to another embodiment, still in the case of a reusable garment, the absorbent material is received removably in permeable internal envelopment means, for example in the form of a permeable flap or extension permanently connected on one side, for example by stitching, to the permeable lining alone or also to the waterproof material. This flap or extension being intended to be folded back and closed onto its opposite edge by any removable fixing means. Such a removable fixing means is chosen from the group comprising notably self-gripping strips, zip fasteners, press studs or buttons. The free edge of the flap being disposed close to the elastic sealing device or internally on the opposite side to the absorbent strip.

In a variant, the flap can be designed so as to be completely removable whilst being provided on its two sides with fixing means such as those defined above on the internal part of the garment.

According to another variant, the flap is designed so as to be double in the form of two strips positioned so as to overlap over a part of their width at their free edge, in order to constitute a removable closure, permanently fixed to their external edge, in order to define an envelope opening out at the central part at the free end of the two strips.

According to another variant, the means of enveloping the absorbent band consist of an envelope consisting of a folded strip permanently fixed to the permeable lining alone or also to the waterproof material on one face and provided with any fixing means such as a self-gripping strip, buttons etc on the free edges of the fixed and opening faces, situated either close to the sealed closures, or on their opposite side with respect to the absorbent strip.

In this way, if the emission of urine is greater, it will be contained in these absorbent strips, which can easily be replaced.

The required effect will remain the same: the person will be wet, but not the bedding.

According to another characteristic, the garment consists of panels connected together sealingly by welding or stitching.

BRIEF DESCRIPTION OF THE DRAWINGS

The present invention will be described below in detail with the help of the accompanying drawings, which present, by way of non-limitative example, the preferential embodiments mentioned above, in which.

DETAILED DESCRIPTION OF THE PREFERRED EMBODIMENTS

Figure 1:
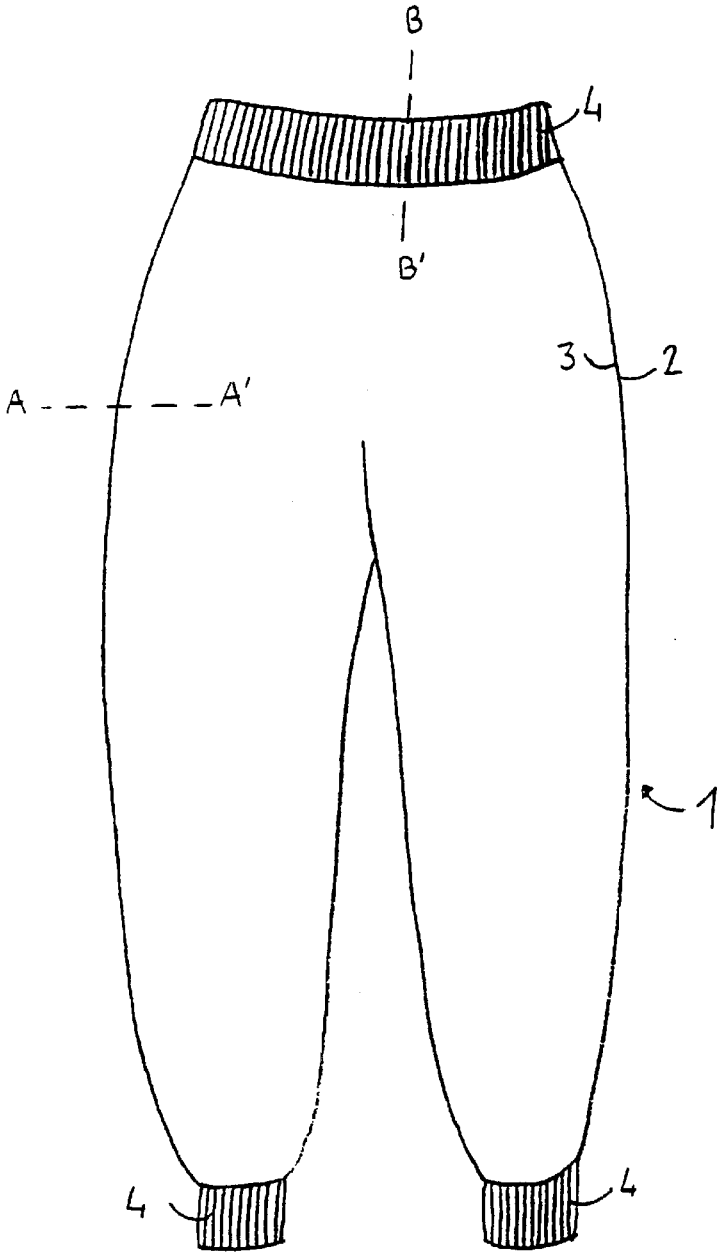
FIG. 1 depicts a front view of pajama trousers according to the invention.

With reference to these drawings, the following references represent:

1. trousers
2. impermeable external layer
3. permeable internal layer
4. elastic sealed closure
5. absorbent strip
6 and 6'. permeable flap
7. removable fixing means
8. adhesive strip for fixing the absorbent strip
9. complete envelope for removable absorbent strip
10. sealed closure hem
11. stitching FIG. 1 depicts pajama trousers (1) according to the invention. These pajama trousers are discreet and resemble ordinary pajama trousers, which can also be matched with a pajama jacket, either through the presence of a strip of identical colour, a pattern or any other decorative element on its external face (2) and provided at its ends with sealing devices (4).

Figure 2A:
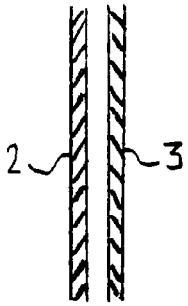
FIG. 2*a* is a section along AA' of the trousers depicted in FIG. 1.
Figure 2B:
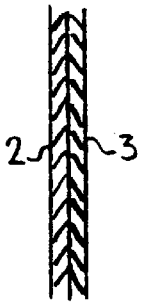
FIG. 2*b* is a section similar to that in FIG. 2*a* of another embodiment of the trousers according to the invention.

As illustrated in FIG. 2*a*, the trousers (1) are produced from a material composed of two distinct layers, an impermeable external layer (2) and an internal layer permeable to fluids (3). According to another embodiment, illustrated in FIG. 2*b*, the pyjama trousers (1) are produced from a material with a single double-face layer, an internal textile face (3) coated with a waterproofing covering (2) by gluing or any other means.

Figure 2C:
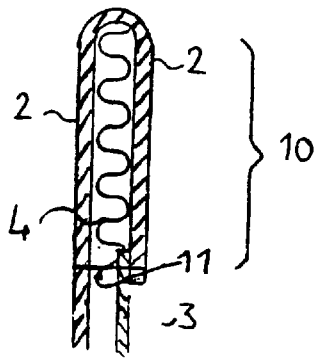
FIGS. 2*c* to 2*h* are sections along BB' of the trousers depicted in FIG. 1, depicting different variant embodiments of the sealed closure device with various possible positionings of the elasticated band and of the material, internally permeable or not, at the hem produced in the waterproof material.
Figure 2D:
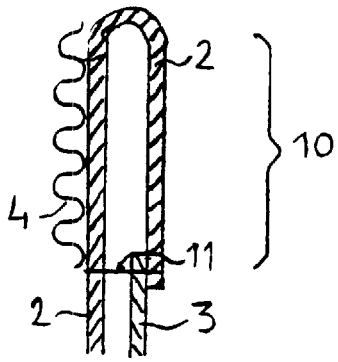
Figure 2E:
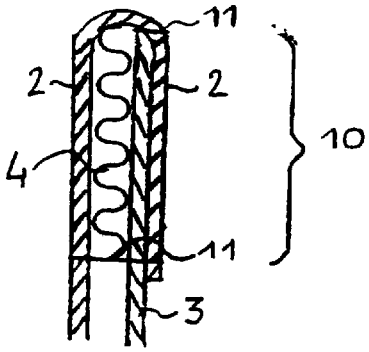
Figure 2F:
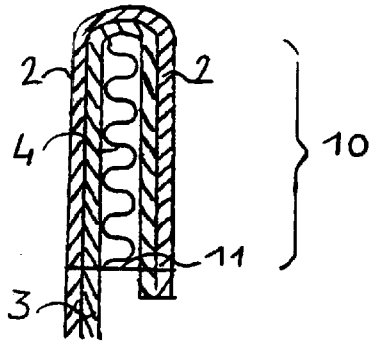
Figure 2G:
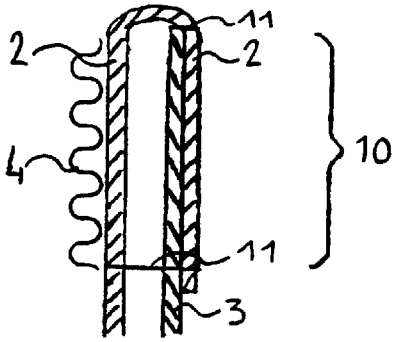
Figure 2H:
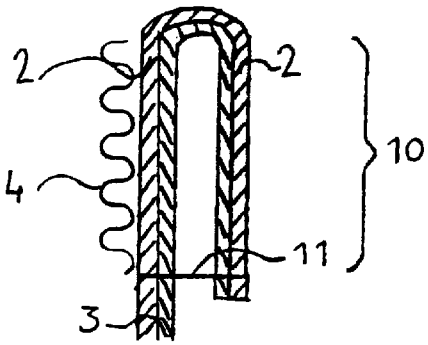

FIGS. 2*c* to 2*h* illustrate particular embodiments concerning the elastic sealed closures. The elastic or the elasticated band (4) is disposed either in (FIG. 2*c*) or externally (FIG. 2*d*) by stitching (11) to a hem (10) in the waterproof material formed at the ends of the garment, and the permeable material (3) is stopped before the hem (10) (FIGS. 2, 2*d*) or extended inside the hem (10) (FIGS. 2*e, f, g, h*).

Figure 3:
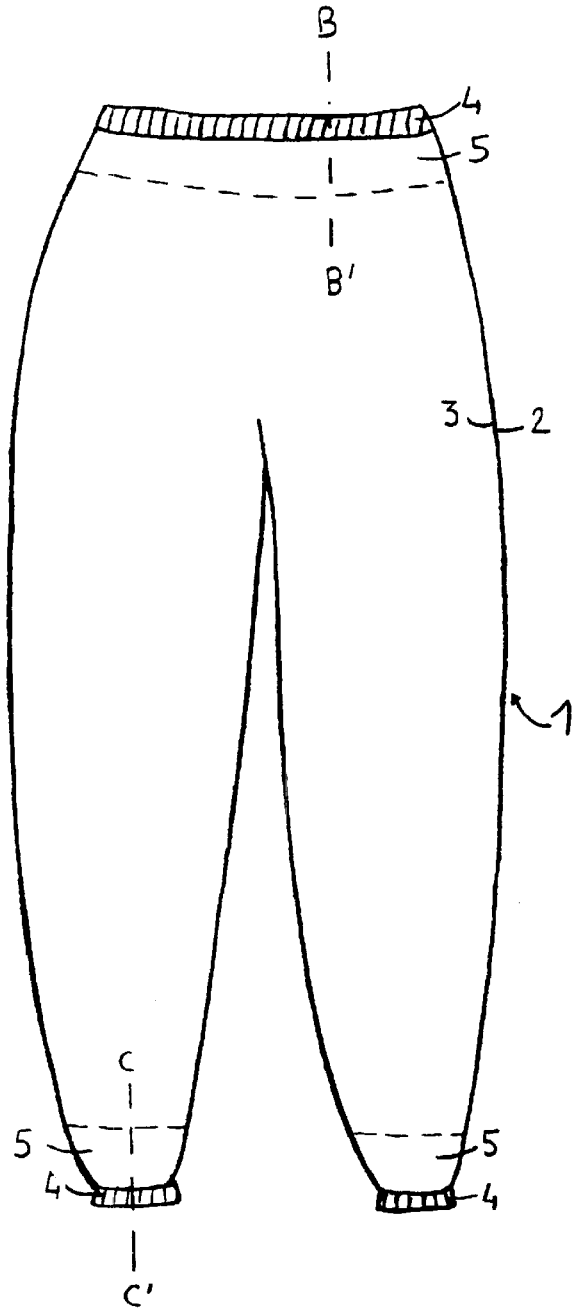
FIG. 3 is a front view of pajama trousers incorporating strips of absorbent material.

FIG. 3 illustrates another embodiment of the garment according to the invention which has pieces of absorbent material, in the form of absorbent strips (5) disposed close to a sealing device (4) consisting of a single narrow piece of elastic.

Figure 4:
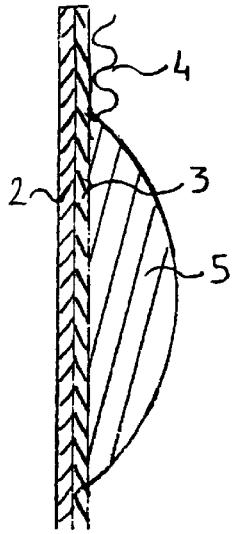
FIG. 4 is a section along BB' in FIG. 3 showing the holding of the absorbent strip.

In FIG. 4 the absorbent strip (5) for disposable trousers is glued close to the sealing device (4).

Figure 5:
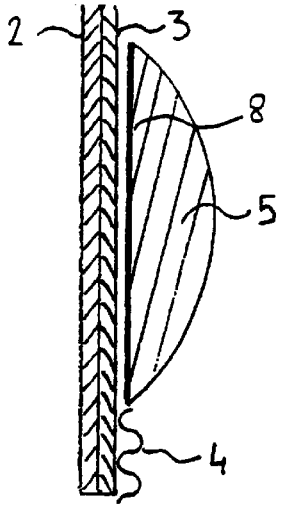
FIGS. 5, 6*a*, 6*b*, 7, 8, 9*a* and 9*b* depict, in section along CC' in FIG. 3, variant embodiments of the holding of the absorbent strip, for the reusable trousers.

In FIG. 5 the absorbent strip (5) for the reusable trousers is disposed removably on the internal face of the garment, this strip being provided on one face with a strip or a covering (8) which is adhesive or for fixing by contact affording holding on the internal part of the garment close to the ends (4).

Figure 6A:
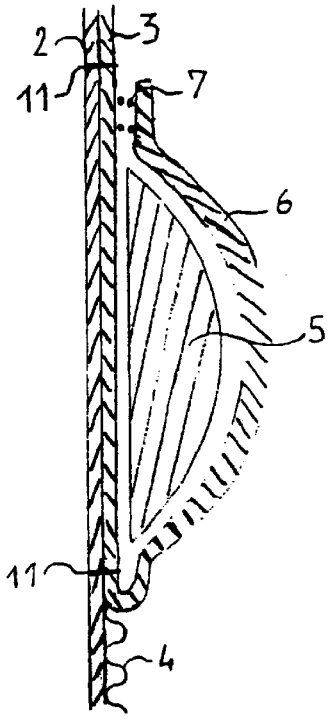
Figure 6B:
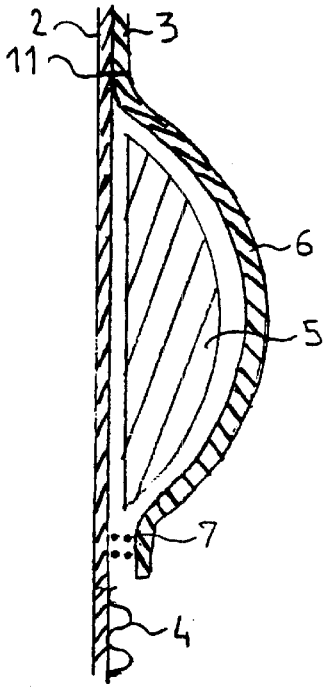

FIGS. 6*a* and 6*b* depict in section reusable trousers, the absorbent strip (5) adjacent to the sealed closure (4) is inserted in a permeable flap (6) consisting of the permeable material closed at the free end by removable fixing means such as press studs (7), this flap being permanently fixed (11) on the opposite side, either close to the sealing device (FIG. 6*a*), the permeable material in this case being provided with a width greater than the impermeable material in order to constitute an extension turned over internally in order to form the flap, or on the opposite side (FIG. 6*b*), the permeable material having a length substantially corresponding to that of the impermeable material and being permanently fixed (11) to the waterproof material (2) upstream at a distance from the sealed closure (4) slightly greater than the width of the absorbent band in order to form, under this flap thus defined, the housing for a removable absorbent strip (5).

Figure 7:
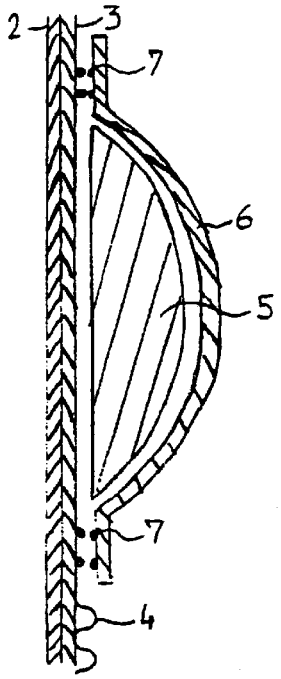

FIG. 7 depicts as a variant an attached removable flap (6) with a width greater than that of the absorbent strip and provided in this case, on its two lateral sides, with removable fixing means (7) cooperating with the complementary ones provided on the garment and as defined above.

Figure 8:
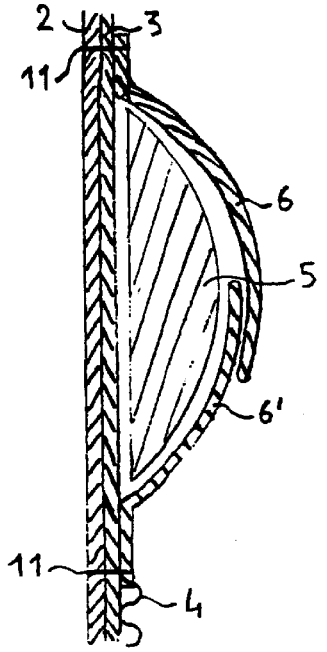

FIG. 8 depicts another variant in which the flap is provided so as to be double in the form of two attached strips (6) (6' ) positioned so as to overlap in the central area over part of their width, permanently fixed (11) on their external side, either to the permeable material alone, or to it and to the impermeable material, in order to define an envelope opening out at the central part at the free end of the two strips like a pillowcase.

Figure 9A:
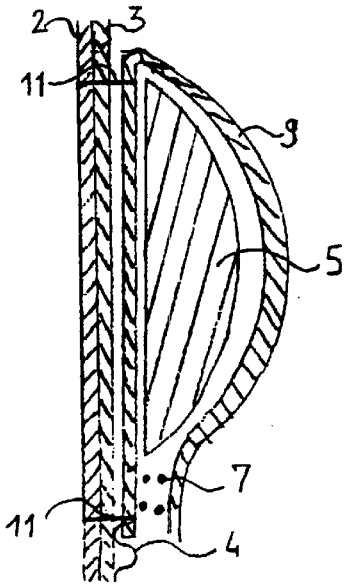
Figure 9B:
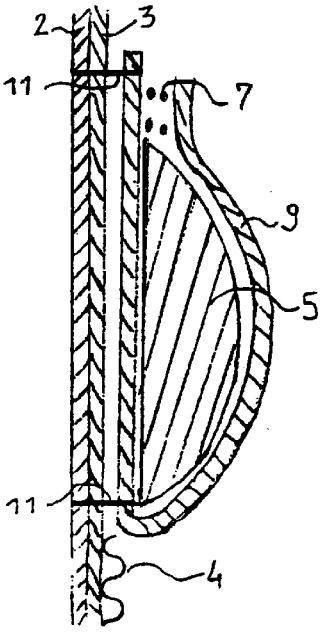

In FIGS. 9*a* and 9*b* a complete envelope (9) in the form of a strip folded on itself is provided so as to be attached and permanently fixed (11) by one face to the inside of the garment close to sealed closures (4) and provided with removable fixing (7) such as self-gripping strips, buttons etc on the free end of its other face held in abutment on complementary means at the end of its fixed face so as to enclose an absorbent sealing strip (5).

The use of the garment according to the invention, in its two forms, is able to give rise to significant savings on several levels:

- electrical consumption (washing machine and possibly dryer),
- water consumption (washing machine),
- detergent, softener,
- rapid wear on linen (pyjamas, sheets, undersheet etc) caused by frequent washing,
- accelerated wear to the washing machine and dryer,
- work and time spent changing the bedding, washing it, remaking the bed, possibly occasioning additional costs for paying a home help.

The secondary benefits are no less:

- use of the invention prevents additional fatigue to the mother (generally) and additional work, enabling her to be more available to her child,
- the user child becomes more independent and can more easily take responsibility for its enuresis by itself rinsing, for example, its reusable trousers,
- finally, use of the invention in its two forms enables the child to spend nights away from its home. Previously, attending a summer camp was difficult, a stay with grandparents tricky, a night at friends impossible. Henceforth, wearing the pyjamas according to the invention enables a child to spent nights at a hotel or in rented accommodation, at friends or with the family, alone or with its parents, or in a summer camp. And this without even the family circle or little friends necessarily being aware of the enuresis of the child, who can now confront its problem more serenely. It will suffice, in the morning, for it to throw away its disposable garment—if it has wetted it—and then take its normal shower.

Naturally, this night garment can also be used during the day, alone or under other garments, notably in the case with children undergoing toilet training, this garment always being in contact with the skin.

What is claimed is:

1. A night garment intended for children who are enuretic or are undergoing toilet training, or for incontinent persons, the garment comprising:

- an impermeable external face;
- a permeable internal face coming into contact with the skin of a wearer of said garment;
- sealing devices made of elastic material, which are placed near ends of said garment, for preventing a flow of urine outside said garment;
- said permeable internal face being made of a material not enabling a wearer of said garment to keep dry and on the contrary giving the sensation of being wet; and
- pieces of absorbent strips disposed on said permeable internal face close to said sealing devices.

2. The garment according to claim 1, wherein said material defining the permeable internal face is a woven material.

3. The garment according to claim 1, wherein said material defining the permeable internal face is a knitted material.

4. The garment according to claim 1, wherein said material defining the permeable internal face is a non-woven material based on one of cotton and synthetic fibers.

5. The garment according to claim 1, wherein said sealing devices comprise at least one elastic element at said ends of the garment.

6. The garment according to claim 1, comprising a material composed of at least two superimposed layers that are said impermeable external layer and said internal layer permeable to fluids.

7. The garment according to claim 1, comprising a material composed of a single layer having two faces that are said impermeable external face and said internal face permeable to fluids.

8. The garment according to claim 1, wherein said impermeable external face is a cloth coated with waterproofing.

9. The garment according to claim 1, wherein said impermeable external face is at least one of polyethylene, PVC, polyurethane, and rubber.

10. The garment according to claim 1, wherein said pieces of absorbent strips are fixed to the internal face of the garment by one of gluing, adhesive fixing, and contact.

11. The garment according to claim 1, further comprising, close to said sealing devices and internal to said garment, means for permeably enveloping said pieces of absorbent strips.

12. The garment according to claim 11, wherein said means for enveloping said pieces of absorbent strips comprises a permeable flap permanently connected on one side to said garment and having another side connected to said garment by a removable fixing means, a free edge of said flap being disposed close to said sealing devices.

13. The garment according to claim 11, wherein said means for enveloping said pieces of absorbent strips comprises a permeable flap which is removable and provided on each of two edges with means for removably attaching said flap to an interior of said garment.

14. The garment according to claim 11, wherein said means of enveloping the pieces of absorbent strips comprises a double flap, in the form of two strips, each having a free edge, said strips overlapping at their free edge to constitute a removable closure permanently fixed to an interior of said garment.

15. The garment according to claim 11, wherein said means of enveloping the pieces of absorbent strips comprises an envelope formed by a folded strip having a face permanently fixed to an interior of said garment and an opening face, fixing means being provided at free edges of said fixed face and said opening face.

16. The garment according to claim 11, comprising panels connected together sealingly by welding or stitching.

17. The garment according to claim 11, which is in the form of trousers.

18. The garment according to claim 11, which is in the form of bermuda shorts.

19. The garment according to claim 11, which is in the form of a pajama with long trousers.

20. A garment for training an incontinent person, the garment comprising:

a waist portion having an elastic waistband for preventing passage of a fluid;

two leg portions that each have an elastic waistband for preventing passage of a fluid;

the garment being made of a material that has a permeable internal face that contacts a wearer when the garment is being worn and an impermeable external face, said internal face retaining fluid so that a wearer of the garment senses a presence of a fluid retained in said internal face;

each of said waist portion and said two leg portions having an annular pocket on said internal face next to a respective said elastic waistband, each said annular pocket comprising a flap having at least one edge with means for selectively detachable attachment of said at least one edge to the garment;

a first fluid absorbent strip in said pocket around said waist portion;

a second fluid absorbent strip in each said pocket of said leg portions.

* * * * *